US008024820B2

(12) United States Patent
Weimer et al.

(10) Patent No.: US 8,024,820 B2
(45) Date of Patent: Sep. 27, 2011

(54) MULTI-PIECE PROTECTOR FOR A BASEBALL CATCHER

(75) Inventors: Ken Weimer, Irvine, CA (US); Dmitry Rusakov, Montreal (CA)

(73) Assignee: Easton Sports, Inc., Van Nuys, CA (US)

( * ) Notice: Subject to any disclaimer, the term of this patent is extended or adjusted under 35 U.S.C. 154(b) by 29 days.

(21) Appl. No.: 12/037,384

(22) Filed: Feb. 26, 2008

(65) Prior Publication Data

US 2009/0211001 A1 Aug. 27, 2009

(51) Int. Cl.
*A41D 13/00* (2006.01)

(52) U.S. Cl. ..... 2/463

(58) Field of Classification Search ..... 2/16, 22, 2/24, 102, 108, 2.5, 467, 44, 45, 459–460, 2/464, 463
See application file for complete search history.

(56) References Cited

U.S. PATENT DOCUMENTS

| | | | | |
|---|---|---|---|---|
| 5,987,654 | A * | 11/1999 | Chartrand | 2/462 |
| 6,678,899 | B2 | 1/2004 | Fiorini et al. | |
| 6,748,601 | B2 | 6/2004 | LaShoto et al. | |
| 6,826,786 | B2 | 12/2004 | Fiorini et al. | |
| 7,065,800 | B2 | 6/2006 | Brown | |
| 7,103,924 | B2 * | 9/2006 | Morrow et al. | 2/461 |
| 7,647,651 | B2 * | 1/2010 | Contant et al. | 2/459 |

* cited by examiner

*Primary Examiner* — Tejash Patel
(74) *Attorney, Agent, or Firm* — Perkins Coie LLP

(57) ABSTRACT

A multi-piece chest protector includes a front section connected to side sections by straps or other connectors that provide independent and relative movement between the front section and the side sections. The front and side sections include padding for absorbing impact. Additional padding, such as shoulder pads, may optionally be removably or permanently attached to the chest protector.

15 Claims, 3 Drawing Sheets

MULTI-PIECE PROTECTOR FOR A BASEBALL CATCHER

BACKGROUND

Protective gear, such as chest protectors, helmets, masks, and shin pads, has long been used to protect baseball catchers from pitched balls and balls foul-tipped off of bats. Chest protectors are typically made from a relatively flexible material, and have padding sewn into the flexible material for absorbing the impact of a pitched or tipped baseball. Straps are commonly attached to the chest protector for securing the chest protector around the back of the catcher.

While existing chest protectors have been relatively effective at protecting catchers from pitched and tipped balls, they typically restrict the catcher's upper body and arm movements to some degree. This can be problematic, for example, for a catcher who is trying to throw out a runner attempting to steal a base. In these situations, the catcher typically has to quickly hop into an upright position and accurately throw the baseball to a base ahead of the runner so that a teammate can receive the ball and tag out the runner before the runner reaches the base. Due to the somewhat restrictive nature of a typical chest protector, however, it is often difficult for a catcher to quickly and accurately make a throw, particularly because the entire chest protector shifts as a single unit against the catcher's upper body and throwing arm. The restrictive nature of existing chest protectors can also cause a catcher difficulty when reaching for a pitched, thrown, or batted ball. Thus, a need exists for a flexible chest protector that does not restrict a catcher's ability to quickly and accurately throw a baseball or to move to catch a baseball.

SUMMARY

A multi-piece chest protector includes a front section connected to side sections or a rear section (which may include one or more side sections) by straps or other connectors that provide independent and relative movement between the front section and the side sections or rear section. The front and side sections or rear section include padding for absorbing impact.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
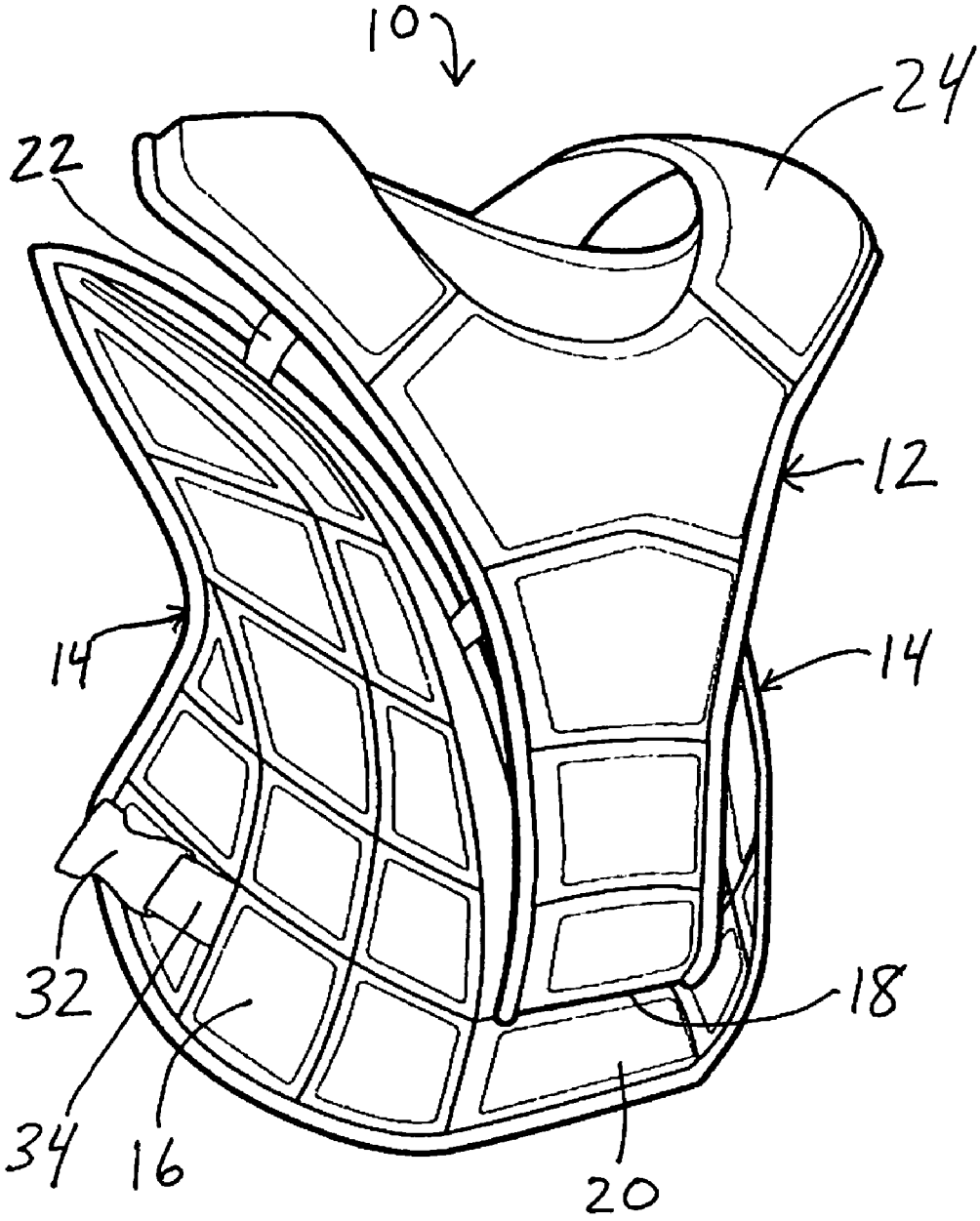
FIG. 1 is a front-side perspective view of a multi-piece chest protector, according to one embodiment.
Figure 2:
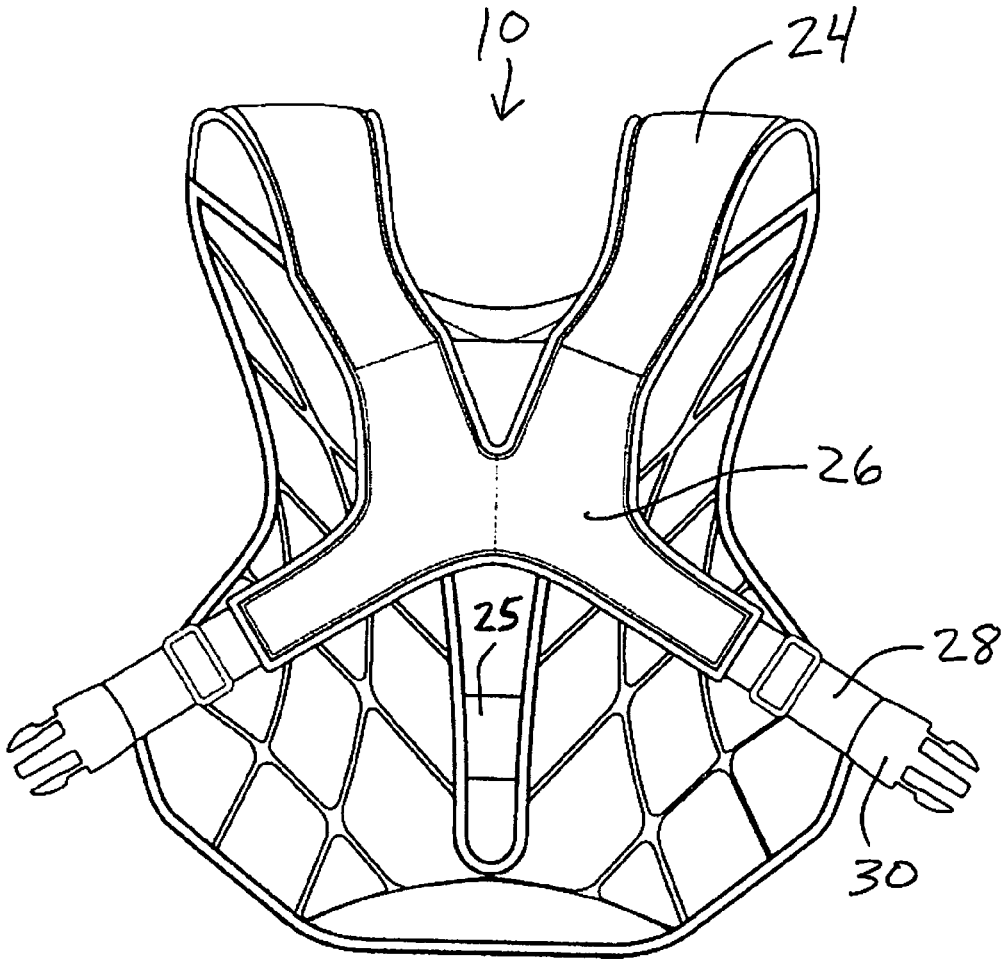
FIG. 2 is a rear perspective view of the chest protector shown in FIG. 1.
Figure 3:
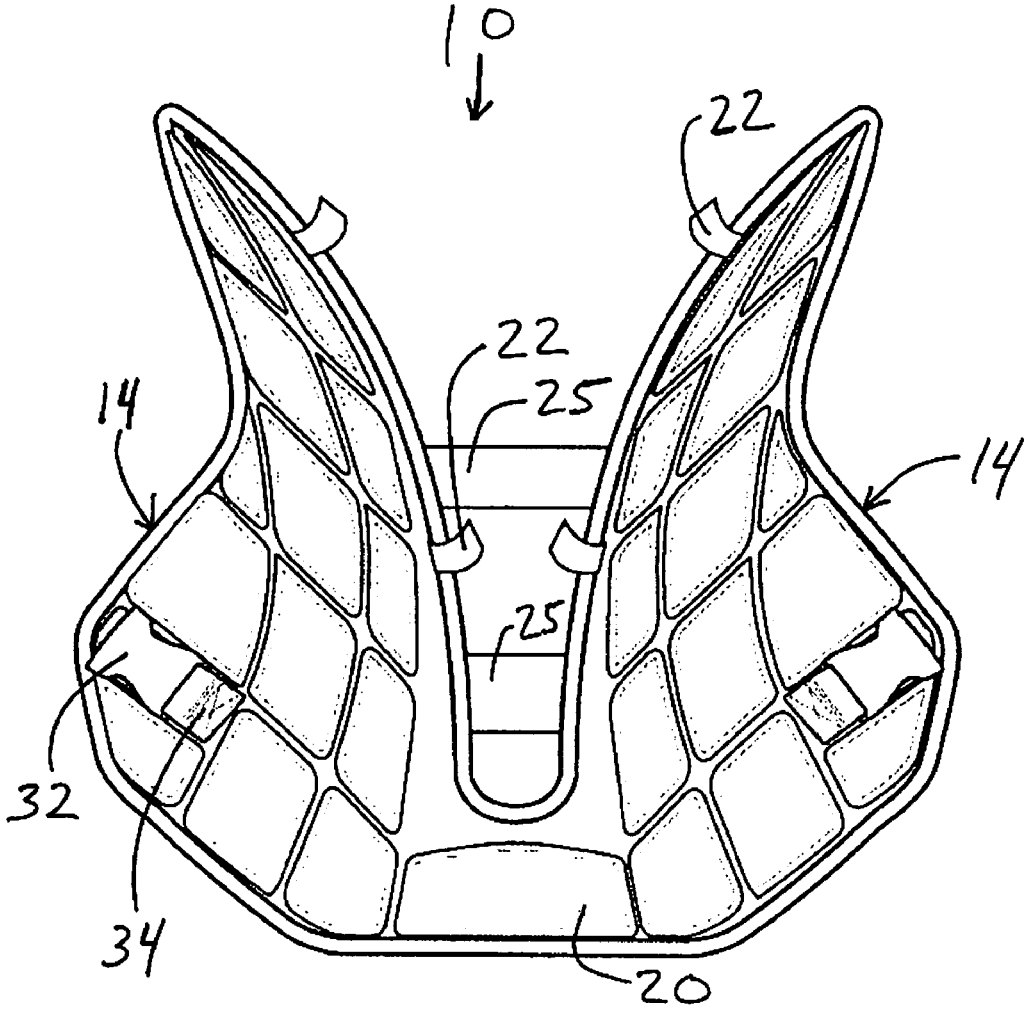
FIG. 3 is a front perspective view of the chest protector shown in FIGS. 1 and 2 with the front section omitted for clarity.

Turning now in detail to the drawings, as shown in FIGS. 1-3, a chest protector 10 includes a central or front section 12 (which is omitted for clarity in FIG. 3) connected to one or more side sections 14, or to a rear section (which may include one or more side sections 14). Each of the front and side sections 12, 14 is preferably made of a flexible material, such as nylon or another suitable material. A plurality of pads 16 are preferably sewn into the flexible material for protecting the front torso, and optionally the sides, of a wearer. The pads may be made of a foam material, such as "memory foam," or of any other material suitable for absorbing impact and protecting the wearer.

The pads 16 are preferably aligned in rows within or between the front section 12 and the side sections 14 such that the rows can flex relative to one another. Thus, when a catcher wearing the chest protector 10 moves or bends, the rows of pads 16 can flex to accommodate the catcher's movements. The pads 16 may alternatively be arranged in any other suitable manner.

In the illustrated embodiment, a bottom end 18 of the front section 12 is sewn or otherwise fixedly attached to a lower section 20 of the chest protector 10. The lower section 20 is sewn or otherwise fixedly attached to a lower region of each the side sections 14. Thus, in this embodiment, as is best shown in FIG. 3, the side sections 14 are physically connected to each other by at least the lower section 20, such that the side sections 14 and the lower section 20 essentially form a unibody construction. For descriptive purposes, this unibody construction will be referred to as including multiple side sections 14. In an alternative embodiment, the side sections 14 may be physically separated from each other. For example, the side sections 14 may optionally be connected only to the front section 12, or may be connected to each other by straps or other connectors that provide spacing between the side sections 14.

The front section 12 is connected to each of the side sections 14 by at least one strap 22, cord, or similar element (collectively referred to herein as "straps"), which may be sewn or otherwise fixedly connected to the front and side sections 12, 14. In the illustrated embodiment, two straps 22 are used to connect each side section 14 to the front section 12. The two straps 22 are positioned at approximate mid and upper regions of the side section 14. Alternatively, a greater or lesser number of straps 22 may be positioned at any suitable regions of the side sections 14. For example, it may be desirable to include a third strap 22 at a lower region of each side section 14 to provide increased flexibility and relative movement between the front and side sections 12, 14. The side sections 14 may optionally be connected to each other, preferably behind the front section 12, by one or more additional straps 25, as well. The straps 22 are optionally made of an elastic material, such as nylon or spandex, such that they are stretchable under loading conditions and can return to their original length when the load is removed.

The straps 22 may be any length suitable to provide a desired amount of spacing, and thus, relative and independent movement, between the front section 12 and the side sections 14. For example, any of the straps 22 may have a length of 0.5 to 4.0 inches, or 1 to 2.0 inches, or any other desired length. As the length of the straps 22 increases, the available relative and independent movement between the front section 12 and the side sections 14 increases. In one embodiment, the upper straps 22 are slightly longer than the mid or lower straps 22 such that a greater amount of movement is provided near the catcher's upper torso.

The front section 12 preferably includes padded upper regions 24 configured to extend over a catcher's shoulders to the back of the catcher. The upper regions 24 are preferably sewn or otherwise fixedly attached to a flexible back section 26 that engages the rear torso of a wearer. The flexible back section 26 optionally includes padding for providing comfort to a wearer. The flexible back section 26 is preferably sewn or otherwise fixedly attached to two or more adjustable straps 28, or other suitable connectors, each having an attachment element 30 at its free or distal end. The adjustable straps 28 are optionally made of an elastic material, such as nylon or spandex, such that they are stretchable under loading conditions and can return to their original length when the load is removed.

One or more receiving elements 32 are preferably attached to a lower region of each of the side sections 14, via straps 34 or other suitable elements, for receiving the attachment elements 30. A catcher may don the chest protector 10 by pulling it over his or her head, such that the upper regions 24 rest on the catcher's shoulders and the back section 26 rests against the rear torso of the catcher. The catcher may then insert the attachment elements 30 into the corresponding receiving elements 32. Any other suitable connecting mechanisms may of course be used to secure the chest protector 10 to the wearer.

Additional padding may optionally be permanently or removably attached to the chest protector 10. Shoulder pads or upper arm pads, for example, may be removably attached to upper regions of the side sections 14 via hook and loop fastening material or via any other suitable connectors. Including removable pads provides a catcher with the option to remove, for example, a pad that would otherwise protect the catcher's throwing shoulder, thus providing increased freedom of movement when throwing a ball. Alternatively, a catcher could remove a pad that would otherwise protect the catcher's non-throwing shoulder, thus providing increased freedom of movement when reaching for a pitched, batted, or thrown ball. Other additional pads may optionally be included to protect various regions of the wearer's body.

The inclusion of the straps 22 provides independent and relative movement between the front section 12 and the side sections 14. As a result, a catcher can freely move his or her upper body and arms, which allows the catcher to more easily throw or reach for a ball without restriction from the chest protector 10. This relative or independent movement also reduces restriction of a catcher who is running to catch a foul ball, for example.

Any of the above-described embodiments may be used alone or in combination with one another. Furthermore, the chest protector may include additional features not described herein. The concepts described herein may also be applied to other protective gear. Thus, they are not limited to a catcher's chest protector. While several embodiments have been shown and described, various changes and substitutions may of course be made, without departing from the spirit and scope of the invention. The invention, therefore, should not be limited, except by the following claims and their equivalents.

What is claimed is:

1. A chest protector, comprising:

a front section providing an opening for a head of, and including padding for protecting a front torso of, a wearer, wherein the front section includes padded upper regions configured to extend over a wearer's shoulders to the back of the wearer; and a side section including padding for protecting the front torso of a wearer, with the side section connected to the front section by at least one strap located below the head opening, such that the front section is movable independently of, and relative to, the side section.

2. The chest protector of claim 1 wherein the chest protector comprises two side sections each connected to the front section by at least one strap.

3. The chest protector of claim 2 wherein each of the side sections is connected to the front section by three straps.

4. The chest protector of claim 2 wherein the two side sections are connected to each other behind the front section by at least one strap.

5. The chest protector of claim 1 wherein the at least one strap provides spacing between the front section and the side section.

6. The chest protector of claim 1 wherein a lower region of the side section is sewn to a lower region of the front section.

7. The chest protector of claim 1 wherein the at least one strap is made of an elastic, stretchable material.

8. The chest protector of claim 1 further comprising a flexible back section attached to the upper regions for engaging the rear torso of the wearer.

9. The chest protector of claim 8 further comprising at least two adjustable straps attached to the back section, with each adjustable strap including an attachment element at a free end of the strap.

10. The chest protector of claim 9 further comprising at least two receiving elements attached to lower regions of the side section for receiving the attachment elements.

11. A chest protector, comprising:

a padded, forward-facing front section including padded upper regions configured to extend over a wearer's shoulders to the back of the wearer;

a padded, substantially forward-facing first side section attached to the front section by at least one strap, such that the first side section is movable independently of, and relative to, the front section; and a padded, substantially forward-facing second side section attached to the front section by at least one strap, such that the second side section is movable independently of, and relative to, the front section;

wherein each of the first and second side sections are configured to overlie at least a region of the torso located below the shoulders of a wearer.

12. The chest protector of claim 11 further comprising a lower region connecting the first side section to the second side section, wherein a bottom region of the front section is sewn to the lower region.

13. The chest protector of claim 11 wherein the first side section is connected to the second side section by at least one additional strap.

14. The chest protector of claim 13 wherein the at least one additional strap connects the first side section to the second side section behind the front section.

15. The chest protector of claim 11 further comprising a flexible back section attached to the upper regions for engaging the rear torso of the wearer.

* * * * *